United States Patent [19]

Ostermann

[11] 3,981,223

[45] Sept. 21, 1976

[54] BRAIDING MACHINE

[75] Inventor: Max Ostermann, Wuppertal, Germany

[73] Assignee: W. & M. Ostermann, Wuppertal, Germany

[22] Filed: Feb. 25, 1975

[21] Appl. No.: 552,786

[30] Foreign Application Priority Data

Feb. 27, 1974 Germany ..... 2409341

[52] U.S. Cl. ..... 87/50; 87/37; 87/44

[51] Int. Cl.² ..... D04C 3/06

[58] Field of Search ..... 87/37, 38, 50, 55, 33, 87/44, 62

[56] References Cited

UNITED STATES PATENTS

| | | | |
|---|---|---|---|
| 2,458,379 | 1/1949 | Hobourn et al. | 87/50 |
| 2,960,905 | 11/1960 | Scanlon | 87/55 |
| 3,748,952 | 7/1973 | Petzetakis | 87/50 X |
| 3,774,497 | 11/1973 | Stahl | 87/55 |
| 3,783,736 | 1/1974 | Richardson | 87/50 X |
| 3,795,171 | 3/1974 | Strangfeld | 87/50 |
| 3,854,375 | 12/1974 | Lefevre | 87/55 |

*Primary Examiner*—John Petrakes
*Attorney, Agent, or Firm*—Michael J. Striker

[57] ABSTRACT

A plurality of bobbin supports is movable along an endless track and each has a guide portion which engages the track, and a motion-transmitting portion. An arrangement is provided for advancing the bobbin supports along the track and includes a plurality of rotary drivers which are arranged along the track and which each have an angularly movable circular plate provided in a circumferential margin thereof with angularly spaced recesses each located in a sector of the plate. The margins of adjacent ones of the plates overlap one another and the motion-transmitting portions are engageable in the respective recesses so as to share part of the angular movement of the respective plate prior to engaging the margin of the adjacent plate and entering into a recess of the latter. A sound-damping arrangement is provided at the margins so as to dampen sound when the margins are engaged by the bobbin supports.

13 Claims, 6 Drawing Figures

BRAIDING MACHINE

BACKGROUND OF THE INVENTION

The present invention relates generally to a braiding machine, and more particularly to a braiding machine having a plurality of bobbin supports which are movable along a track. The invention is suitable with particular advantage, although not exclusively, to a braiding machine which applies braid onto a hose. Such braiding machines are shown in German Pat. No. 517,586 of Feb. 5th, 1931.

Braiding machines of this type have bobbin supports which carry respective supply bobbins, that is bobbins carrying a supply of filament, bead, thread, wire or the like. The bobbin supports are movable along a track and are advanced along the track by an arrangement whose operation is similiar to that of a Geneva motion.

The problem with the prior-art machines of this type is that the bobbin supports alternately engage and disengage a plurality of rotary drivers which are arranged along the track and which serve to engage the motion-transmitting portion of the bobbin supports in order to advance the latter along the track. The engagement of the motion-transmitting portions with the drivers involves entry of a motion-transmitting portion into one of a plurality of circumferentially spaced recesses on the respective driver, advancement with the rotating driver through a portion of arc, movement outwardly of the recess and into engagement with the periphery of an adjacent driver, movement along this periphery through a small distance and entry into a recess in the periphery of the adjacent driver, whereupon the operation repeats with respect to a further driver.

Braiding machines are widely known for the very considerable noise level which they develop in operation, and which results from the contact of the motion-transmitting portions of the bobbin supports with the respective drivers. It has been proposed to line the recesses in the peripheries of the drivers with synthetic plastic material, but it was then discovered that this does not materially aid in reducing the noise level during operation. Moreover, it is not advisable to use any significant amount of synthetic plastic material for the movable components of the braiding machine, such as the motion-transmitting portions of the bobbin supports, because such synthetic plastic material tends to wear quite rapidly and this leads to frequent repairs with the necessary machine downtime.

SUMMARY OF THE INVENTION

Accordingly, it is a general object of this invention to overcome the disadvantages of the prior art.

More particularly, it is an object of the invention to provide an improved braiding machine which is not possessed of the aforementioned disadvantages, particularly of the high noise level in operation.

A further object of the invention is to provide such a braiding machine which is reliable in operation and which has an improved lifetime due to reduced wear.

In keeping with these objects, and with others which will become apparent hereafter, one feature of the invention resides, in a braiding machine, in a combination which, briefly stated, comprises guide means defining an endless track, and a plurality of bobbin supports movable along the track and each having a guide portion engaging the track, and a motion-transmitting portion. Means is provided for advancing the bobbin supports along the track and includes a plurality of rotary drivers arranged along the track and each having an angularly movable circular plate provided in a circumferential margin therof with angularly spaced recesses each located in a sector of the plate. The margins of adjacent ones of the plates overlap one another and the motion-transmitting portions are engageable in the recesses so as to share part of the angular movement of the respective plate prior to engaging the margin of the adjacent plate and entering into a recess of the latter. Sound-damping means is provided at these margins at least in that region of each sector which is located forwardly of the respective recess with reference to the angular movement, so as to reduce the noise resulting from engagement between the margins and the bobbin supports.

The invention is based upon the realization that the main reason for the high noise level of a braiding machine in the prior art is the impacting of the edges of the guide plates on the base of the bobbin supports with the radially outer edge of the circular plate of the rotary drivers. The reason for this is that the guide plates as well as the circular plates are not always very precisely positioned, or else can move out of their original precisely positioned location to a slight extent, and then can contact one another. The result of this is that at the transfer point where a bobbin support begins to be transferred from one driver to another, the guide plate of the bobbin support tends to assume a position which is conformed to that of the new rotary driver to which the bobbin support is being transferred. At the time at which a recess of the new driver engages the motion-transmitting portion of the bobbin support, in order to start advancing the bobbin support along the guide track, the undesired noise has already occurred.

The invention eliminates the problem at its root, so to speak, in that it provides the sound-damping means at the location of the respective rotary driver where the first contact occurs between the driver and the bobbin support, i.e., where in the prior art the noise develops as a result of such contact. Since the engagement is only brief and no particular stresses act in the regions in question, it has been quite surprisingly found that the sound-damping means of the present invention is subject to very little wear and therefore has a considerable lifetime.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 5:
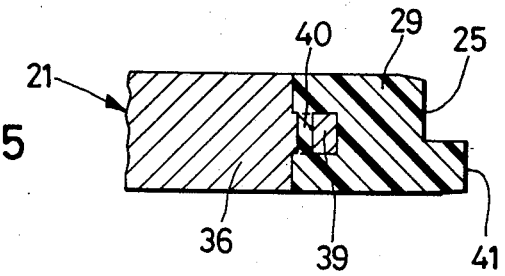
FIG. 5 is a sectioned detail view illustrating a detail of further embodiment of the invention on an enlarged scale.

FIGS. 1–4 and 6 illustrate an embodiment of the invention; FIG. 5 illustrates a detail of a modified embodiment.

The braiding machine in which the present invention is incorporated has not been shown in detail, because such braiding machines are well known to those having skill in the art. For this reason, only those components have been illustrated and will be described which are essential for an understanding of the invention.

Figure 2:
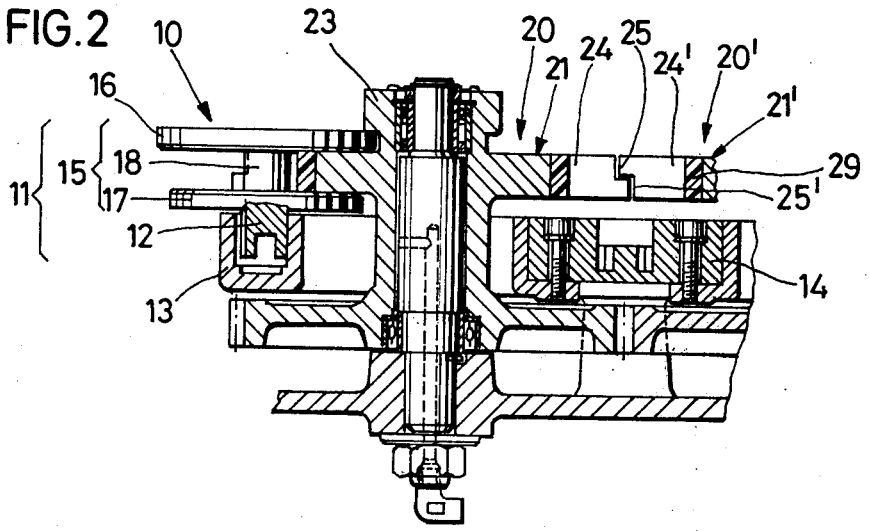
FIG. 2 is a vertical section taken on line II—II of FIG. 1, including components which are omitted in FIG. 1.
Figure 1:
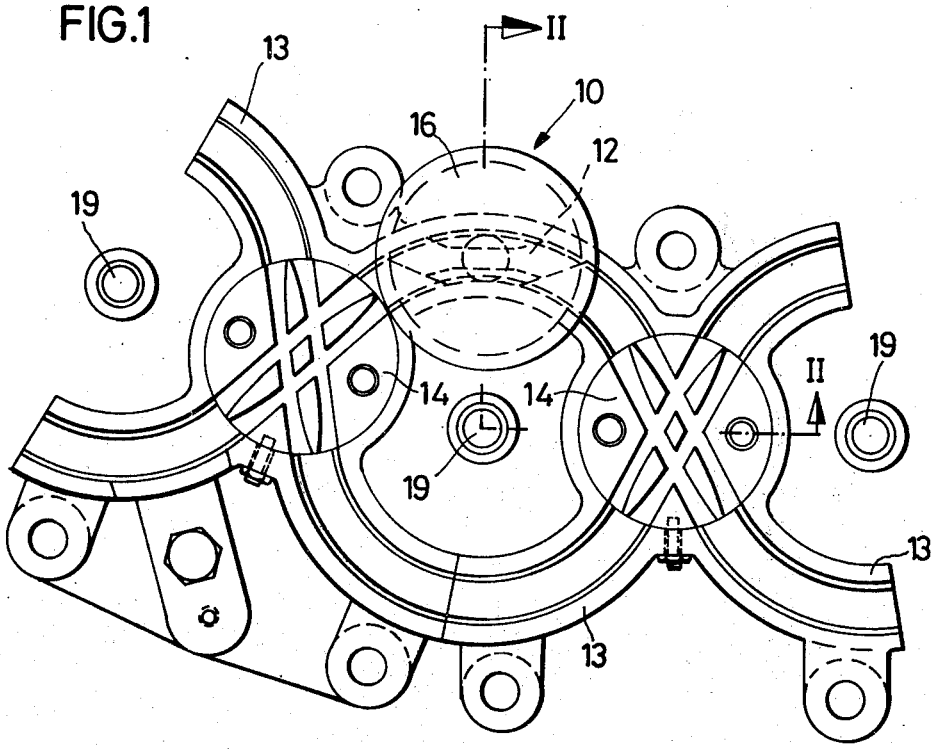
FIG. 1 is a fragmentary top-plan view illustrating components of a braiding machine which are necessary for an understanding of the invention, other components having been omitted for the sake of clarity and only a single bobbin support being shown.
Figure 6:
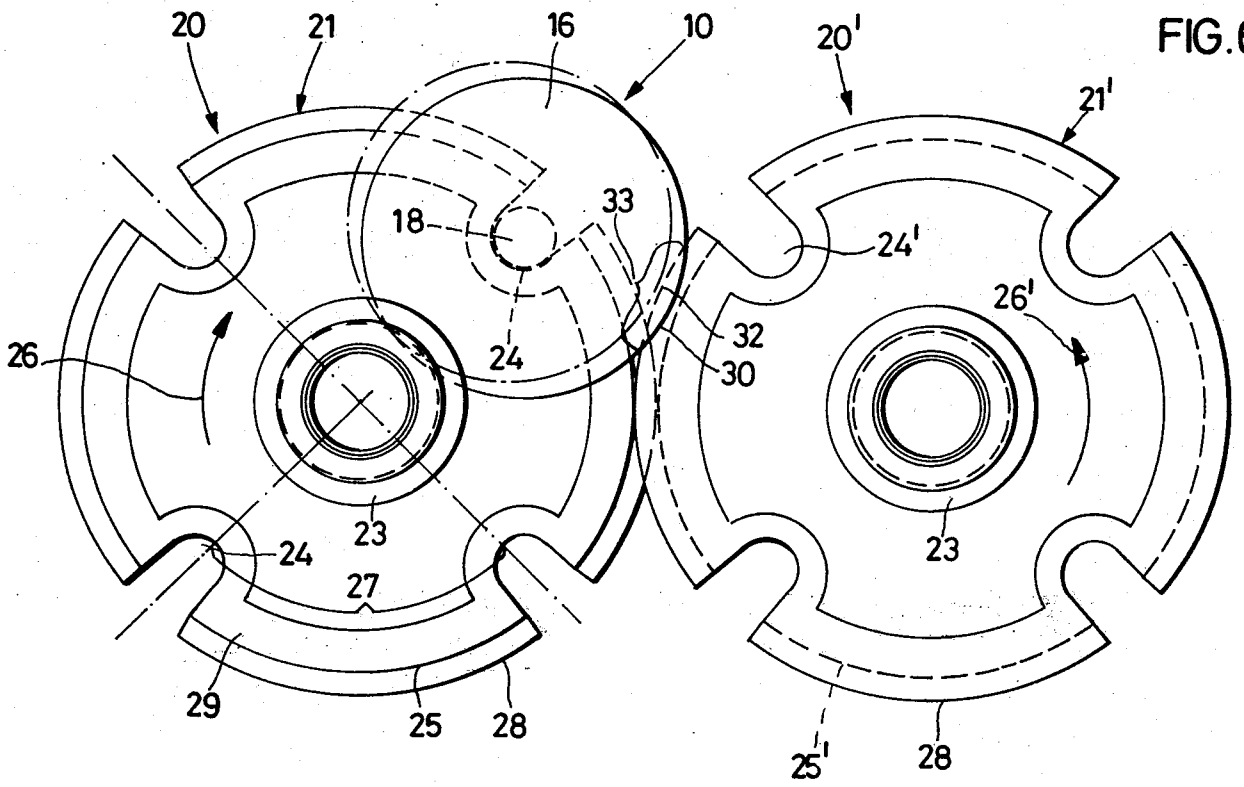
FIG. 6 is a top-plan view illustrating two adjacent rotary drivers of the machine according to the present invention at the time of transfer of a bobbin support from one to the other driver.

The braiding machine has a plurality of bobbin supports 10 each of which supports one or more spools or bobbins of filaments, and the associated control devices for setting and regulating the filament tension. Neither the bobbins nor the regulating and control devices are illustrated, because they also are conventional. In FIGS. 1, 2 and 6 only a single bobbin 10 has been shown, because the invention can be explained with reference to a single bobbin, since evidently this explanation will be applicable to all of the bobbins 10.

The bobbin 10 which is shown by way of example has a bottom 11 provided with a guide portion 12 which engages into a rail or track 13 that is composed of a plurality of arcuate portions which are shown particularly clearly in FIG. 1 wherein the rotary drivers have been omitted for the sake of clarity. Since the guide portion 12 is guided by and moves along the rail 13, it is the rail which determines the movement to be performed by the respective bobbin support 10. The track formed by the rail 10 has two portions; the bobbin support 10 will first move in one of the portions in one direction and then in the other portion in the opposite direction. Where the two portions of the track cross one another, connecting portions 14 are inserted which serve the purpose of permitting the bobbin supports 10 to move across these junctions.

Upwardly of the guide portion each bobbin support 10 is provided with a drive section 15 composed of an upper plate 16 and a lower plate 17 which are connected by a pin 18 that constitutes a motion-transmitting portion. The diameter of the upper plate 16 is slightly in excess of that of the lower plate 17.

Figure 3:
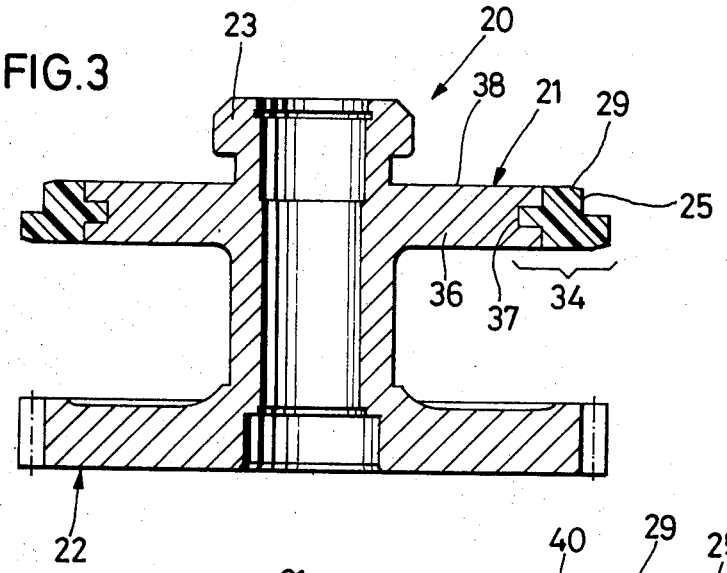
FIG. 3 is an axial section through a rotary driver according to the present invention, as used in FIGS. 1 and 2.

The movement of the bobbin supports 10 along the track defined by the rails 13 is effected by a plurality of rotary drivers 20 which are arranged along the track at the locations 19 shown in FIG. 1 and which cooperate with the motion-transmitting portions 18 of the respective bobbin supports 10 in the manner of a Geneva motion. FIG. 3 shows clearly that the illustrated rotary driver 20 (which is representative of all of the others) has a circular plate 21 at the exterior of the machine and a gear plate 22 in the interior of the machine and provided with a circumferentially extending annulus of gear teeth. The plate 22 is located below the level of the track 13 and its teeth engage with a drive gear (not illustrated) so that the rotary driver 20 is rotated. The gear plates 22 of the adjacent rotary drivers 20 mesh with one another. Each driver 20 further has a hub 23 whose configuration is shown in FIG. 3.

Figure 4:
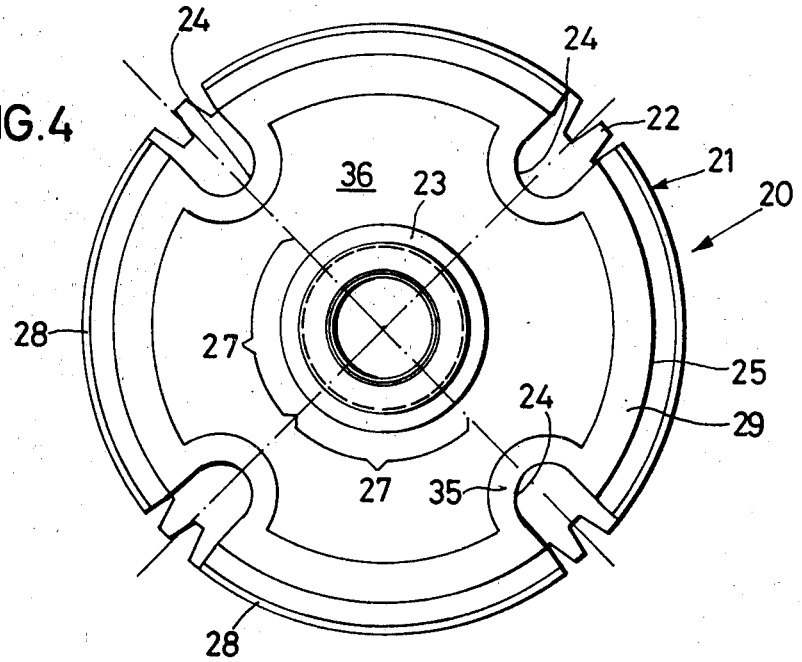
FIG. 4 is a top-plan view of FIG. 3.

As FIG. 4 shows more clearly, the circular plate 21 of the respective driver 20 is provided with a plurality of marginal recesses 24 which are equiangularly spaced from one another. In the illustrated embodiment, four of the recesses 24 are provided, but a larger number, such as eight, could also be provided.

In operation, the upper plate 16 of the respective bobbin support 10 moves onto the exposed side of the circular plate 21 of the rotary driver 20 with which the bobbin support 10 cooperates at the particular moment; at the same time the plate 17 of the bobbin support 10 engages the lower or inner side of the plate 21. Also at this time the motion-transmitting portion 18 of the bobbin support 10 enters into one of the recesses 24 of the plate 21 and is taken along as the driver 20 is rotated, thus causing the bobbin support 10 to travel along the track defined by the rail 13 in the direction of rotation of the respective driver, by sharing part of the angular (i.e., rotary) displacement of the plate 21 thereof.

FIG. 2 shows that the circumferential margins of the plates 21, 21′ of adjacent drivers 20, 20′ overlap one another; for this purpose the circumferential margins are stepped in a complementary manner, as illustrated at 25 and 25′. The plates 21, 21′ assume during their rotation respective positions in which the recesses 24, 24′ of the adjacent plates 21, 21′ are located opposite one another so that the motion-transmitting portion 18 of a bobbin support 10 can leave the recess 24 of the plate 1 and enter into a recess 24′ of the plate 21′.

FIG. 6 shows how the transfer of a bobbin support 10 from one driver 20 to an adjacent driver 20′ is accomplished. It will be seen that the drivers 20 and 20′ rotate in mutually opposite directions, as indicated by the arrows 26 and 26′. The solid-line showing of the plate 16 of the bobbin support 10 shows that a portion 30 of the periphery of the plate 16 at this time overlaps the margin of the plate 21′ of the driver 29′ to which the bobbin support 10 is to be transferred from the driver 21. At this time, however, the motion-transmitting portion 18 of the bobbin support 10 is still spaced by a significant distance from the circumference of the plate 21′, and is still received in the associated recess 24 of the plate 21. This means that at this time the advancement of the bobbin support 10 is dictated exclusively by the angular motion of the plate 21. At the time at which the plate 16 assumes the full-line position in FIG. 6, the transfer of the bobbin support 10 from the driver 20 to the driver 20′ presents no problem in terms of the development of noise.

However, the noise problem occurs at the time at which the plate 16 is in the broken-line position **16*a*, shown in FIG. 6. At this time at which the closest recess 24′ of the plate 21′ which can and eventually will engage the motion-transmitting portion 18 of the bobbin support 10 is still spaced by a significant angular distance from the point of transfer, a contact already exists between the peripheral portion 30 and a circumferential contact location 32 of the plate 21′. Because of unavoidable deviations in the relative positions of bobbin support 10 and plate 21′, a noisy engagement between bobbin support 10 and plate 21′ will result, be it because of contact of the plate 21′ with the plate 16 or with the plate 17. The sectors 27 between the recesses 24 or 24′ of a respective plate 21 or 21′ are the portions which support the plates 16 and 17 of the bobbin support 10. In order to avoid the undesired noise, the invention provides for the provision of a zone or portion of noise-damping material, particularly synthetic plastic material which is elastically yieldable, at that marginal portion 33 of a respective sector 27 of the plate 21 or 21', where the contact point 32** is located. It has been found that a plastic material available commercially under the tradename "Vulkollan" * is especially suitable, although other materials of synthetic plastic and having the requisite capability of elastically yielding can also be used.

* Vulkollan is produced by Farbenfabriken BAYER A.G., Leverkusen. Vulkollan is a cast polyurethanelastomer, made from a polyol (e.g. polyether or polyester) a polyisocyanate and chain extender (e.g. 1,4-butandiol or aromatic diamine). Other suitable materials are: e.g. Adiprene produced by Dupont.

The portion 33 is always located ahead of (in the direction of rotation) the respective recess 24 or 24'. There is therefore obtained a good buffer effect at the location 32, which is especially advantageous if the entire outer radial edge 28 of the plates 21 or 21' is provided with this zone, as illustrated in FIG. 4.

It is currently preferred if the entire plate 21 or 21' is surrounded by a rim 29 of such synthetic plastic damping material. The rim 29 has a width 34 so selected that the steps 25, 25' can be formed in the rim. Moreover, the recesses 24 and 24' are advantageously also lined with a curved portion 35 of the frame 29. The flanks of the recesses 24 are bounded by this portion of the frame.

FIG. 3 shows the exact configuration of the frame 29. The plate 21 (and, of course, the plate 21') has a metallic center or core 36 which is provided in its outer circumferential edge face in the region of the respective sector 27 with a radial groove 37 which is so shallow that in the region of the recesses 34 it does not extend into the core 36. It extends parallel to the surface 38 and is located substantially midway between the opposite end faces of the plate 21 or 21'. The frame 29 is advantageously produced by forming it directly onto the core 36 in appropriate form, so that its material enters into the groove 37 and couples the frame 29 with the core 36.

The embodiment which is illustrated in FIG. 5 corresponds in all details to that of FIGS. 1–4 and 6, except that the radial groove 37 is replaced by a radially projecting rib 39 which also extends parallel to the surface 38 and in this case is embedded in the material of the frame 29. The rib 39 may be provided with a plurality of axially extending holes or bores 40 into which the synthetic plastic material of the frame 29 can enter. It is advantageous to locate the rib 39 in the region of the projecting portion 41 of the step 25, so that the profiling in the frame 29 will be located at the same level as the rib 39.

Of course, as pointed out before, the frame 29 need not be continuous but instead the damping could also be applied in individual portions on the respective sectors 27.

It will be understood that each of the elements described above, or two or more together, may also find a useful application in other types of constructions differing from the type described above.

While the invention has been illustrated and described as embodied in a braiding machine, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a braiding machine, a combination comprising guide means defining an endless track; a plurality of bobbin supports movable along said track and each having a guide portion engaging said track, and a motion-transmitting portion; means for advancing said bobbin supports along said track, including a plurality of rotary drivers arranged along said track and each having an angularly movable circular plate provided in a circumferential margin thereof with angularly spaced recesses each located in a sector of said plate, the margins of adjacent ones of said plates overlapping one another and said motion-transmitting portions being engageable in said recesses so as to share part of the angular movement of the respective plate prior to engaging the margin of the adjacent plate and entering into a recess of the latter; and sound-damping means provided at said margins at least in the region of initial contact between the respective sector and motion-transmitting portion, such region being located forwardly of the respective recess with reference to said angular movement, so as to reduce the noise resulting from engagement between said margins and said bobbin supports.

2. A combination as defined in claim 1, wherein said sound-damping means comprises portions of non-metallic material.

3. A combination as defined in claim 1, wherein said rotary drivers each have a motion-receiving gear portion located at a level below said track for engagement with a cooperating drive gear.

4. A combination as defined in claim 1, wherein said sound-damping means comprises portions of elastically yieldable synthetic plastic material.

5. A combination as defined in claim 1, wherein said sound-damping means comprises an annular portion of elastically yieldable synthetic plastic material extending along the margins of the respective plates.

6. A combination as defined in claim 1, wherein each of said margins is stepped and has a radially projecting portion, said radially projecting portions overlapping one another.

7. A combination as defined in claim 6, wherein said sound-damping means comprises an annular rim of elastically yieldable synthetic plastic material extending circumferentially of the respective plate and constituting said margin thereof, said annular rim being stepped and having said radially projecting portion.

8. A combination as defined in claim 1, wherein said plates each have a metallic center portion and said sound-damping material comprises an annular rim of elastically yieldable synthetic plastic material which surrounds said center portion and constitutes said margins of the respective plate.

9. A combination as defined in claim 8, said metallic center portion having an outer circumferential edge face surrounded by said rim and formed with a circumferential groove into which said rim in part extends so as to be coupled with said metallic center portion.

10. A combination as defined in claim 8, said metallic center portion having an outer circumferential edge face surrounded by said rim and formed with a circumferentially extending projecting rib which is embraced by the material of said rim so that the latter is coupled with said metallic center portion.

11. A combination as defined in claim 10, wherein said rim has a peripheral edge which is stepped and has a radially projecting portion which overlaps with a similar radially projecting portion of a respective adjacent plate; and wherein said rib is located substantially at the same level as said radially projecting portion of the respective plate.

12. A combination as defined in claim 10, where in said rib is formed with a plurality of bores and some of the material of said rim fills each of said bores.

13. A combination as defined in claim 12, wherein said bores extend substantially axially of said plate.

* * * * *